US005105804A

United States Patent [19]

Van Nostrand

[11] Patent Number: 5,105,804

[45] Date of Patent: Apr. 21, 1992

[54] APPARATUS AND METHOD FOR PRODUCING MILD, SUSTAINED BALANCED TRACTION ON THE LOWER BACK

[76] Inventor: Willard R. Van Nostrand, 3737 Calle Cortez, Tucson, Ariz. 85716

[21] Appl. No.: 535,366

[22] Filed: Jun. 8, 1990

[51] Int. Cl.[5] ..... A61H 1/02

[52] U.S. Cl. ..... 606/241; 4/621; 4/573.1; 128/66; 441/129

[58] Field of Search ..... 128/75, 65, 66, 68, 128/69, 78; 272/1 B, 71; 441/77, 78, 79, 81, 88, 108, 129; 4/573, 621

[56] References Cited

U.S. PATENT DOCUMENTS

| | | | |
|---|---|---|---|
| 1,827,057 | 10/1931 | Wills | 441/108 |
| 2,145,289 | 1/1939 | Boudreaux | 441/108 |
| 4,396,012 | 8/1983 | Cobiski | 128/75 |
| 4,551,108 | 11/1985 | Bass | 441/116 |
| 4,632,387 | 12/1986 | Guzman | 272/116 |
| 4,722,329 | 2/1988 | Kalvag | 128/75 |
| 4,798,550 | 1/1989 | Biancucci | 272/71 X |
| 4,800,871 | 1/1989 | Florjancic | 128/75 |
| 4,804,177 | 2/1989 | Rosson | 272/71 |

FOREIGN PATENT DOCUMENTS

| | | |
|---|---|---|
| 296348 | 1/1973 | U.S.S.R. . |
| 587936 | 1/1978 | U.S.S.R. . |
| 502532 | 8/1979 | U.S.S.R. . |
| 0741873 | 6/1980 | U.S.S.R. . |
| 745519 | 7/1980 | U.S.S.R. . |
| 1162427 | 6/1985 | U.S.S.R. . |
| 1181659 | 9/1985 | U.S.S.R. . |
| 1292764 | 2/1987 | U.S.S.R. . |
| 1304812 | 4/1987 | U.S.S.R. . |
| 1409260 | 7/1988 | U.S.S.R. . |

OTHER PUBLICATIONS

"Gravity Lumbar Reduction" by Charles V. Burton, *Managing Low Back Pain*, pp. 305–314, Second Edition.

"Function and Pathomechanics of the Sacroiliac Joint, A Review", Reprinted from the Journal of American Physical Therapy Assn., vol. 65, No. 1, Jan. 1985, pp. 35–44.

*Primary Examiner*—Edgar S. Burr
*Assistant Examiner*—Moshe I. Cohen
*Attorney, Agent, or Firm*—Cahill, Sutton & Thomas

[57] ABSTRACT

A method for producing mild, symmetrical (or asymmetrical) traction on lumbar invertebral discs and sacroiliac joints. A patient is supported in water in a spa for approximately 30 minutes by means of an annular floatation device engaging undersides of the patient's arms a predetermined distance from the patient's armpits, the spa being sufficiently deep that the patient's feet cannot touch the bottom. A submerged, symmetrical weight belt is supported on the patient's hips, the buoyant weight of the belt being in the range from approximately 10–20 pounds. The temperature of water in the spa is maintained in the range from approximately 88–94 degrees F. Preferably, the patient remains relatively motionless in the spa for a warm up/relaxation period of approximately 5–10 minutes, followed by a sequence of slow extension and flexion exercise of the patient's back, following by a plurality of side bends.

9 Claims, 2 Drawing Sheets

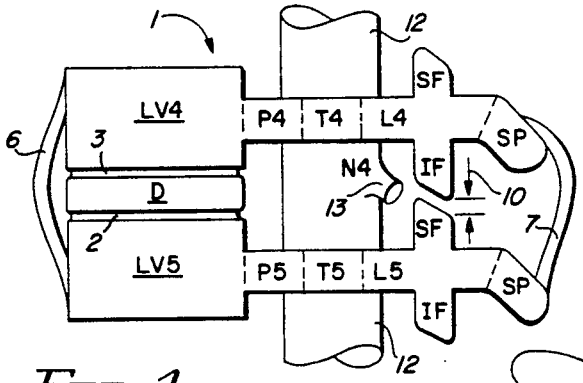
FIG. 1
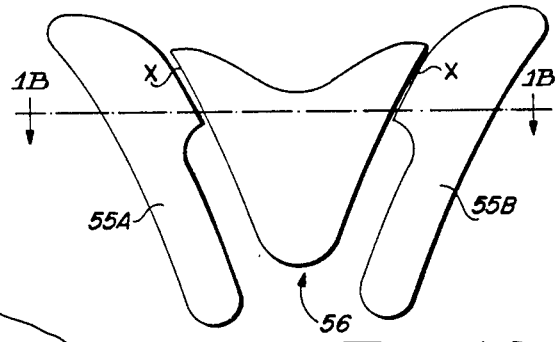
FIG. 1A
FIG. 3
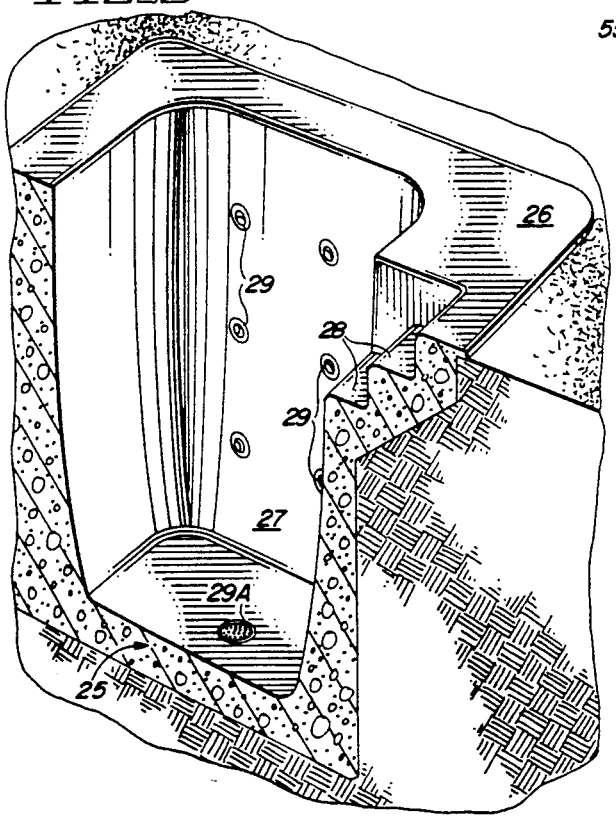
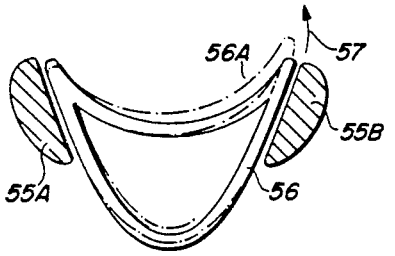
FIG. 1B
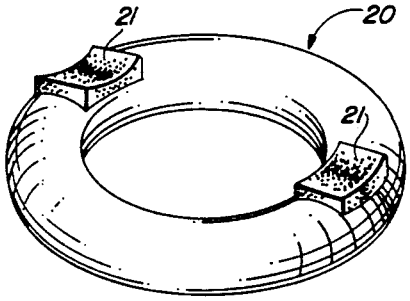
FIG. 2
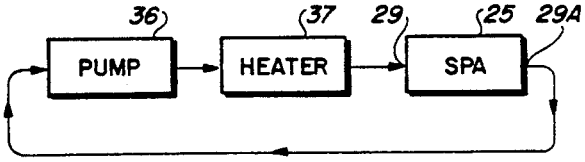
FIG. 4

APPARATUS AND METHOD FOR PRODUCING MILD, SUSTAINED BALANCED TRACTION ON THE LOWER BACK

BACKGROUND OF THE INVENTION

The invention relates to an apparatus and method for treatment of patients with lower back ailments, including paraplegics and patients requiring some level of aerobic conditioning but who cannot endure any impact.

It is well known to physicians that a significant cause of lower back pain is pinching of nerves due to collapsing of vertebral discs in the lumbar spine, and that the resulting pain could be prevented if a better way could be found to avoid premature dying of invertebral disc cells. The premature dying of disc surface tissue results in the thinning or collapsing of the cells. The dying of invertebral disc cells occurs as a result of lack of nourishment. Nourishment of the discs occurs as a result of passive diffusion of nutrient-containing fluids along the upper and lower surfaces of such discs. The nutritional fluids providing the upper and lower disc surfaces with nutrients and water move by passive diffusion along osmotic and hydrostatic gradients in the passages within the vertebral discs and between the adjacent lumbar vertebrae. Consequently, any continually exerted hydrostatic pressure that prevents such passive diffusion also prevents adequate nourishment and hydration of the disc surfaces. This results in premature, unrenewable loss of surface disc cells. In FIG. 1, D designates an intervertebral disc. LV4 designates the fourth lumbar vertebra, LV5 designates the fifth lumbar vertebra, P4 designates the pedicles of L4, L4 designates the lamina of L4, and N4 designates the nerve exiting by L4. s indicates "superior", i indicates "inferior", so sf designates the superior facet, and if designates the inferior facet. Those skilled in the art know that the thoracic spine includes the thoracic vertebrae commonly designated T1–T12, and the lumbar spine includes the lumbar vertebrae commonly designated L1–L5.

Very shallow spaces 2 and 3 exist above and below disc D, between it and lumbar vertebrae LV4 and LV5. The nutrient fluids and gases must diffuse through spaces 2 and 3 every day to nourish the upper and lower surfaces of disc D if premature dying of disc cells is to be avoided.

If the person is awake and involved in normal activities such as standing or sitting, the weight of the person's upper body compresses the lumbar vertebrae LV4 and LV5 against the upper and lower surfaces of disc D, completely eliminating spaces 2 and 3, effectively sealing off the upper and lower surfaces of disc D from the nutrient fluids. When the person sleeps, spaces 2 and 3 ordinarily will open enough to allow diffusion of the nutrient solution and thereby allow adequate nourishment and hydration of the upper and lower surfaces of disc D, because the sleeping person usually is horizontal and his or her body weight does not compress lumbar vertebrae LV4, disc D, and lumbar vertebrae LV5 enough to completely close off passages 2 and 3 to diffusion of the nutrient fluid.

All of the weight of a person's upper body is transferred through the spine into the sacro-iliac joints, which are designed as a double wedge from the top to bottom and from the front to back. FIGS. 1A and 1B illustrate the normal positional relationship of the ilium 55A,B and the sacrum 56. The dotted lines 56A illustrates how the sacrum 56 can become asymmetrically "wedged" against the right hand portion 55B of the ilium 55A,B as the sacrum 56 moves forward toward the front of the person. This happens when the person subjects the sacrum 56 to asymmetrical force or torque that causes only the right hand portion of sacrum 56 to move forward in the direction of arrow 57, and the "wedging" of portion 55B of the ilium prevents sacrum 56 from returning to its normal position from the position indicated by dotted lines 56A.

FIG. 1B shows a rear view of the sacrum 56 and the ilium 55A,B, wherein the letter X designates space between the interface surfaces at which the "wedging" occurs between sacrum 56 and ilium 55A,B. When the sacrum is wedged into the position indicated by dotted lines 56A in FIG. 1B, lower back pain is the result. Conventional traction techniques attempt to remove the sacrum from the position 56A to the position 56 in FIG. 1B. Mild traction can have the effect of tending to increase the spaces designated by letter X in FIG. 1A, effectively "lifting" the sacrum upward from the ilia enough to avoid the above wedging, allowing the sacrum 56A to move from the dotted lines 56 back to its normal position.

Thus, the sacrum is a double wedge that rests between the iliac crests in a position of highest pain-free mechanical position. The distances of wedging movement are small, yet the pain-inflammation-spasm disability from this wedged joint cannot be relieved. Only by "antiwedging" techniques can this problem be solved.

The sacro-iliac (s–i) joints are very irregular in their surfaces and do not readily return to their original anatomic position once out of normal position. A normal muscle achieves a stretch in 15 seconds. An inflamed, toxic, anaerobic spasm-sustained muscle can relax only after a significantly longer period of time, 15 minutes or greater. All surrounding normal muscles will relax first, and then the lengthy process of spasm-relaxation and unwedging can begin.

It is the experience of many patients that a calf cramp or foot cramp, once relieved, has a propensity for respasm shortly after the release spasm prevents joints from going through their full range of motion. Muscles-in-spasm become, in effect, discreet entities which cut off blood, oxygen supply, nourishment and toxin removal. Surrounding muscles which are healthy can stretch sufficiently to "by-pass" a spasm in 15 seconds. If issues of comfort, safety and security are not addressed, adequate relaxation will not occur to allow the spasm to be overcome.

Arthritic and weakened patients often do not have sufficient strength to exercise and move joints through a range of motion because of the influence of gravity, i.e., their body weight. Spasms and continual use of the muscles and joints occurs. To move a lower extremity, the entire lower extremity must be lifted to begin active exercise.

Lower back problems can result from injury and resulting subsequent increased muscular tonicity of muscles, such as those represented by numerals 6 and 7 in FIG. 1, and other large muscle groups which do not appear in the very simplified diagram of FIG. 3. If such muscles become injured, they contract into sustained spasm, preventing spaces 2 and 3 from opening up even when the patient sleeps horizontally. The upper and lower surface tissue of disc D then begins to die, never to be replaced. In FIG. 1 there is a gap designated by arrows 10. Even a millimeter of closure of the gap 10 can result in pinching a portion of a nerve such as N4.

There is a triangular arrangement of three ligament connection points of each vertebrae to the vertebrae above or below it. If force thereon becomes sufficiently unbalanced, too much closure of the vertebrae LV4 in the direction of LV5 against disc D (for example) can result, producing "pinching" by a stressed muscle group on one side of the spinal column and causing excess force on that side, which produces a tilting between the two vertebrae, resulting in pinching of a nerve.

Traditionally, physicians, chiropractors, and others have utilized traction in various attempts to stretch the spine and open the nutrient passages 2 and 3 to allow nutrient solution to diffuse into those regions and nourish the upper and lower surfaces of the disc D. However, during traction, the patient's back muscles remain stressed. Furthermore, during traction most of the traction forces put undue stress on other parts of the body, such as the neck, shoulders, and upper spine.

If all of the relevant muscles are relaxed, only approximately 10–20 pounds of traction between an upper vertebra such as LV4 and a lower adjacent one such as LV5 of FIG. 1 is required to widen the "gap 10" a millimeter or two to relieve nerve pinching and allow efficient diffusion of nutrient fluid into passages 2 and 3. If this condition is maintained for at least half an hour, sufficient nutrient fluid will diffuse through passages 2 and 3 to nourish the upper and lower surfaces of disc D and the adjacent vertebrae surfaces, preventing premature dying of disc tissue and thus preventing the resulting thinning of the disc, decreasing of the gap 10, and pinching of the nerve N4, thereby relieving the resulting lower back pain.

Increased muscular tonicity from stress, pain, or constant pressure increases the strength of contraction of paralumbar muscles. This increases the hydrostatic pressure within the disc, forcing fluids and nutrients out, and prevents replacements thereof from entering. Disc nourishment normally occurs during sleep. Only minor increases in the pressure within the disc passages 2 and 3 will prevent it from being replenished with nutrient fluids. If the "relative pressure" within regions 2 and 3 for a person lying at rest is considered to be equal to 1, and if the person sits up, this raises the relative pressure to a value of 6. If the person then lifts a 20 pound package, the relative pressure is raised to a value of 20. Acting as an elastic tissue, the disc absorbs all of the extra pressure due to its shock-absorbing design, as long as it remains elastic. However, discs which lose a substantial amount of surface tissue due to dying of cells or lose disc contents (nucleus pulposus), do not remain elastic.

U.S. Pat. No. 4,722,329 discloses an apparatus for supporting a patient in water utilizing an overhead member supported by floatation. A Connection around the supporting person by means of a tight vest keeps the person's shoulder and head above the surface of the water. A weight belt is applied to the patient's hips, to apply tension to the person's neck. This reference has the shortcoming that the disclosed device does not allow adequate movement of the upper body, does not provide support for the person's arms, restricts the patient's breathing, and fails to emphasize the need to relax the patient's muscles extending from the sacrum and pelvis up to the patient's chest. This prevents the patient from executing a good range of symmetrical, muscle-relaxing exercises which are important to achieving the benefits of the traction that the apparatus of U.S. Pat. No. 4,722,329 is attempting to achieve. Furthermore, the device is difficult for the user to put on without help. The user probably needs to be in the water to put the apparatus of U.S. Pat. No. 4,722,329 on. The device of U.S. Pat. No. 4,722,329 does not provide a "counter traction" platform to enable the user to bend and flex or extend the spine while using the device.

There is an unmet need for an improved apparatus and method for rehydrating desiccated lumbar intervertebral discs and relieving low back pain and stress without the shortcomings of prior traction techniques and apparatus, yet provides mild, prescribed symmetrical traction, proper body temperature, mild body massaging, avoids constriction of breathing, avoids pinching of armpit nerves, and allows flexion, extension, and bending exercises for the low back with "negative" weight bearing on the lumbar spine.

SUMMARY OF THE INVENTION

Accordingly, it is an object of the invention to provide a mild traction producing apparatus and technique that avoids imbalance caused by stressed muscle groups.

It is another object of the invention to provide an improved apparatus and technique that will produce mild, balanced traction on a person's lumbar spine that overcomes the shortcomings of the closest prior art by providing mild, symmetrical or non-symmetrical lower back traction, proper body temperature, mild body massaging, avoids constriction of breathing and pinching of armpit nerves, and allows back flexion and extension exercises.

It is another object of the invention to provide an apparatus and technique which improves prior techniques of "unwedging" a sacrum from an iliac by allowing effective vertical displacement of the sacrum relative to the iliac and returning of the sacrum to its natural position.

Briefly described, and in accordance with one embodiment thereof, the invention provides a method for rehydration of desiccated lumbar invertebral discs comprising the steps of supporting a patient in water in a deep spa by means of an annular floatation device engaging undersides of the patient's arms a predetermined distance from the patient's armpits, the spa being sufficiently deep that the patient's feet cannot touch the bottom; supporting a submerged weight belt on the patient's hips, the weight belt having a uniform weight distribution, the buoyant weight of the belt being in the range from 10–20 pounds. The method includes maintaining the temperature of the water in the spa in the range from approximately 88–94 degrees F, circulating the water in the spa by pumping water through a plurality of nozzles in the wall of the spa, and keeping the patient in the spa for a time of at least 30 minutes. Preferably, the patient remains relatively motionless in the spa for a warm-up period of approximately 5–10 minutes, followed by a sequence of extension and flexion exercise of the patient's back, followed by a plurality of side bends.

BRIEF DESCRIPTION OF THE DRAWINGS

FIG. 1 is a partial section view diagram of a human spine.

FIG. 1A is a section view of the sacro-iliac joints taken through section line 1A–1A of FIG. 1B.

FIG. 1B is a simplified rear view diagram of the sacroiliac joints.

FIG. 2 is a perspective view of an arm-supporting floatation device used in accordance with the present invention.

FIG. 3 is a partial perspective section view of a deep spa utilized in conjunction with the method of the present invention.

FIG. 4 is a block diagram of a pumping and heating system utilized to supply water to the therapy jets of the deep spa of FIG. 3.

DETAILED DESCRIPTION OF THE PREFERRED EMBODIMENT

Figure 5:
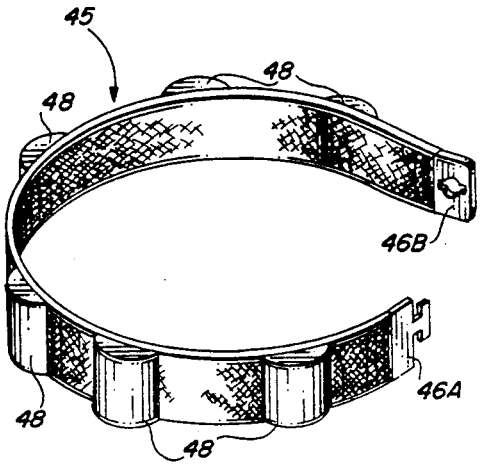
FIG. 5 is a perspective view of a symmetrical weight belt used in accordance with the present invention.

Referring now to the drawings, the present invention accomplishes the above objects by providing the combination of a relatively small, tube-like floatation device 20 which supports a patient's arms (rather than the patient's armpits), a specially constructed deep spa 25, the bottom of which is deep enough that the patient's toes cannot touch it, an optional spa pump, a water heater, therapy jets, and a submerged weight belt 45 with uniformly distributed weight. In FIG. 2, the floatation device 20 includes a preferably inflatable annular ring having an inside diameter of approximately 13–17 inches and an outside diameter of approximately 31–35 inches that would be suitable for a typical adult having a weight in the range of 95–270 pounds. A pair of contoured arm supports 21 optionally are provided to provide comfortable support for the person's arms.

FIG. 3 shows a perspective sectional view of a spa 25, which is at least 6 feet in depth, and has a diameter of approximately 6 feet. Numerals 29 designate conventional therapy jets. Numeral 28 designates steps that allow entry into the deep spa cavity 27. Numeral 29A designates the drain/outlet of spa 25.

FIG. 4 shows the main components of the spa system, including a one and one-half horsepower pump 36, which circulates water in the spa through a heater 37 and into a spa inlet including the therapy jets 29. Water pumped from an outlet of spa 25 is drawn into the inlet of pump 36. Preferably, water temperature is kept in the range from 88–94 degrees Fahrenheit to get maximum relaxation benefit of the present invention. It is important that the temperature not be too cold, because muscles become tense due to overexertion in trying to warm the body heat to an optimum temperature, and this may cause spasms in muscles. Muscle spasms, of course, tend to defeat the purpose of the invention. The water temperature must not be allowed to be too high because of danger of overheating to some people (including certain old persons, pregnant women, and other handicapped patients).

Figure 6:
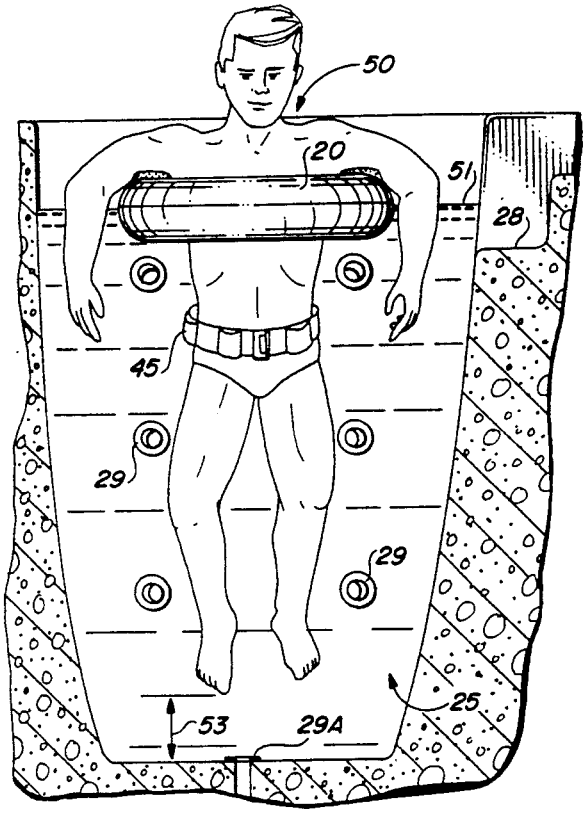
FIG. 6 is a section view diagram of a person being supported in the spa of FIG. 3 utilizing the floatation device and weight belt of the present invention.

FIG. 5 is a perspective view that shows a weight belt 45 used in accordance with the present invention. Weight belt 45 includes a pair of quick connect latch elements 46A and 46B and a plurality of weights 48, which may be symmetrically or asymmetrically distributed around the belt in accordance with the nature of the person's lower back problem. Weight belt 45 weighs 10–20 pounds, and is placed on the person's hips. When the person 50 wearing weight belt 45 is in the spa, as indicated in FIG. 6, his arms are supported on the armrests 21 of a floatation device such as 20 in the water 51 and his body therefore necessarily is supported by his arms, rather than by a tight vest around his chest, as described in above-mentioned U.S. Pat. No. 4,722,329. The weight belt 45 on the person's hips also is submerged. Because of its low buoyant effect, essentially the entire 10–20 pound weight of belt 45 is pressed downward on the person's hips, providing a small, completely symmetrical (or asymmetrical, if that is what the person's condition requires) traction force on the person's lumbar spine. Careful placement of the weights on the iliac crests can result in opening of selected sacroiliac joints, allowing realignment of the sacrum 56 and iliac crests 55A,B. This also results in opening of and a slight negative hydrostatic pressure within the regions 2 and 3 of FIG. 1, causing diffusion of nutrient fluid into those regions.

It should be noted that experiments have shown that increasing the weight of the weight belt 45 above 20 pounds increases upper back fatigue and defeats the purpose of prolonged gentle traction on the back.

It also should be noted that it may be beneficial in some cases to attach weights to the ankles or feet of a person supported in spa 25 as shown in FIG. 3, especially for arthritic patients.

Since the human body is almost neutrally buoyant when completely immersed in water, the present device provides that much of the thorax/lungs will be out of the water and the lower extremities therefore will be "negatively buoyant". The additional application of weights applied to the waist or lower extremities provides a net downward gravity force on the lower back. Thus, leg lifts, tilting of the lower body, and so forth against the floatation platform can be accomplished, and upper body aerobics, cardiovascular conditioning can be accomplished.

The warm temperature of the water and the motion produced by the jets of water ejected from the therapy heads 29, and the inability of the patient to touch the bottom of the pool with his/her feet, provides the combination of temperature, time and relaxing environment with low traction needed to maintain the negative hydrostatic pressure inside the patient's spinal column, resulting in nourishment of the disc tissue. The patient's breathing is not constricted, and if it "feels right" to the patient, the patient can perform gentle exercises that enhance the relaxation effect and decrease the muscular tonicity of the muscles (such as 6 and 7 in FIG. 1, and also other muscle groups) that prevent the spaces 2 and 3 from opening up despite the mild traction being applied. Relaxing music can still further enhance enjoyment of the experience to the patient.

Figure 7:
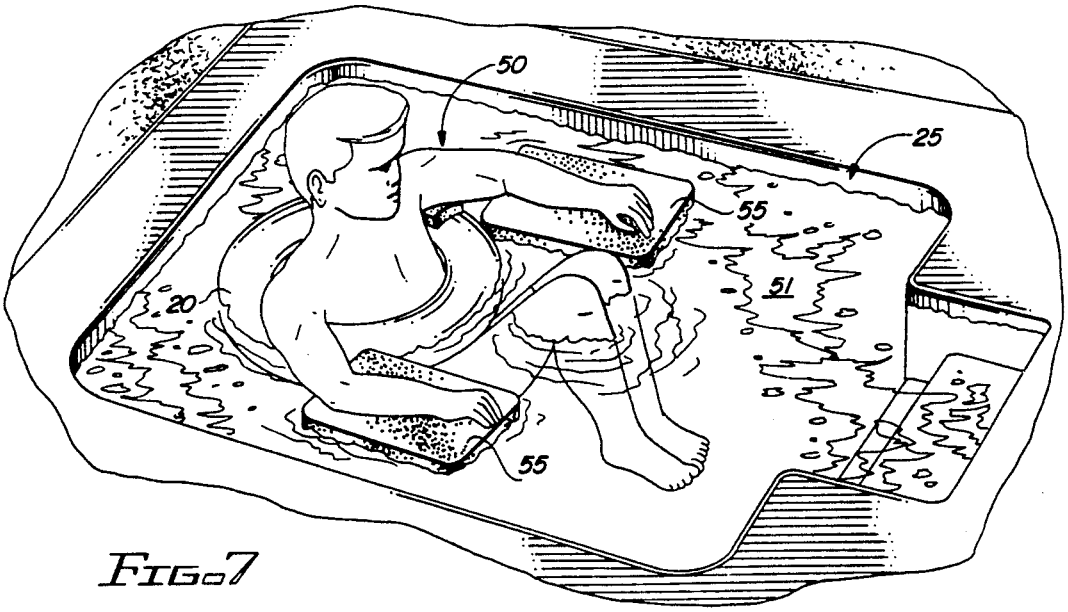
FIG. 7 is a perspective view illustrating use of hand floatation devices to perform gentle muscle-relaxing exercises before or during traction.

Typically, the patient would begin the therapy by spending roughly 5 to 10 minutes of time simply floating in the water, allowing the traction weight produced by the weight belt 45 to gently stretch the entire spine. After this warm up, the patient performs exercises to put the back slowly through a series of flexions and extensions of his or her back against the resistance of the water, followed by side bends and rotations in both directions. The floatation device 20 serves as a stable "platform" from which such gentle exercises can be performed More strenuous, asymmetrical exercises can be performed using one or two separate hand supporting floats 55, as shown in FIG. 7, to allow forward and sideways leg lifts, and the like, and to allow various twisting exercises.

The present invention provides for sustained gentle safe and secure relaxation of the low back and sacro-iliac joints to permit sustained, mild traction-relaxation of these muscles and joint/articular surfaces. This is achieved by distraction of the upper and lower body with freedom to move the LS spine and sacro-iliac (s-i) joints during traction, resulting in relief of spasm and unwedging of the sacro-iliac joints. Weights also can be applied asymmetrically to the sacro-iliac to further isolate the application of forces to unwedge them.

Thus, the invention provides an improved method and apparatus for passive therapies including symmetrical lumbar traction, symmetrical or asymmetrical sacro-iliac joint traction, maximum relaxation to lower blood pressure, stress reduction for heart patients, and treatment of muscle spasm in the lower back.

The improved apparatus and method also allows active therapies including zero impact aerobic exercises for back pain patients, resistance-producing weight and water exercises for the low back, resistance-producing weight and water exercises for lower extremities (which is especially beneficial for arthritics and wheelchair crippled persons) and lumbar spine slow flexion-/extension/side bend exercises, rotation exercises, and slow stretching exercises.

Furthermore, the apparatus and technique of the invention does not constrict the person's breathing, permits mild symmetrical or controlled asymmetrical optimal traction on the person's lower back, and maintains a temperature and body configuration that permits the relaxation needed for renourishment of the discs. Since the disclosed floatation device contacts the person's arms a predetermined distance from the armpits and does not contact the person's armpits other than incidentally and does not compress the person's chest, the person's chest and entire body below the arms and armpits necessarily is supported by the person's arms. The apparatus also allows muscle-relaxing exercise just prior to the traction period, without risk of injury to the person, to allow the traction to be effective. The apparatus also allows aerobic exercise while maintaining a negative pressure in the space between spinal discs, thereby overcoming the disadvantage to many persons of impact aerobics. This is highly advantageous, because when the sacrum is wedged improperly to the ilium as previously explained, every step that the person takes transmits force up through the painful wedged region. This causes impact aerobic exercises to be painful, so the patient usually does not perform them, and the potential benefit of such aerobic exercises is lost. The present invention allows aerobic exercises to be done in the water without impact.

While the invention has been described with reference to a particular embodiment thereof, those skilled in the art will be able to make various modifications to the described embodiment without departing from the true spirit and scope of the invention.

What is claimed is:

1. A method for producing mild traction on lumbar invertebral discs, comprising the steps of:

(a) supporting a patient in water in a deep spa without compressing the patient's chest and constricting the patient's breathing by means of a floating annular floatation device supporting undersides of a person's arms adjacent to the person's armpits, the spa being sufficiently deep that the person's feet cannot touch the bottom;

(b) supporting a submerged weight belt on the patient's hips, the weight belt having a preselected weight distribution, the buoyant weight of the belt being in the range from approximately 10–20 pounds, traction forces originating from the patient's upper thoracic spine extending across the patient's lower thoracic spine and entire lumbar spine and across the patient's sacro-iliac joints; and (c) maintaining the temperature of the water in the spa in the range from approximately 88–94 degrees F.

2. The method of claim 1 including supporting the person in the spa for a time of at least 30 minutes.

3. The method of claim 2 including causing the person to remain relatively motionless in the spa for a warm up period of approximately 5–10 minutes, followed by a sequence of extension and flexion exercise of the person's back, followed by a plurality of side bends.

4. The method of claim 1 including supporting a first hand of the patient by means of a first floatation device floating in the water, the first hand exerting a downward counter-force on the first floatation device sufficient to allow the person to raise his or her legs forward or sideways from a neutral vertical position to provide mobility of the legs after traction and strengthen abdominal muscles 5. The method of claim 3 including circulating the water in the spa by pumping water through a plurality of nozzles in the wall of the spa.

6. The method of claim 3 including distributing weights symmetrically on the belt.

7. The method of claim 3 including distributing the weights asymmetrically on the belt to counter a prediagnosed asymmetrical muscle stress condition in the person's back.

8. An apparatus for producing mild traction on lumbar invertebral discs, comprising in combination:

(a) a spa, the spa being sufficiently deep that the patient's feet cannot touch the bottom;

(b) means for supporting a patient in water in the spa without compressing the patient's chest and constricting the patient's breathing by means of an annular floatation device supporting undersides of the patient's arms adjacent to the patient's armpits;

(c) a submerged weight belt supported on the patient's hips, the weight belt having uniform weight distribution, the buoyant weight of the belt being in the range from 10–20 pounds, traction forces originating from the patient's upper thoracic spine extending across the patient's lower thoracic spine and entire lumbar spine and across the patient's sacro-iliac joints; and (d) means for maintaining the temperature of the water in the spa in the range from approximately 88–94 degrees F.

9. The apparatus of claim 8 including a first floatation device means for countering a downward counter-force exerted by a first hand of the person sufficient to allow the person to raise his or her legs from a neutral vertical position.

* * * * *